United States Patent [19]

Schasser

[11] 3,997,044

[45] Dec. 14, 1976

[54] AUTOMATIC TICKET CHUTE

[75] Inventor: Donald S. Schasser, Pinckney, Mich.

[73] Assignee: Automatic Parking Devices, Inc., Farmington, Mich.

[22] Filed: Apr. 24, 1975

[21] Appl. No.: 571,422

[52] U.S. Cl. ..... 194/4 C; 194/DIG. 23

[51] Int. Cl.[2] ..... G07F 7/08

[58] Field of Search ..... 194/4 R–4 G, 194/DIG. 6, DIG. 23; 209/111, 7; 340/51; 235/61.11 E

[56] References Cited

UNITED STATES PATENTS

| | | | |
|---|---|---|---|
| 3,211,268 | 10/1965 | Dills et al. | 209/111.7 X |
| 3,339,671 | 9/1967 | Simjian | 194/4 R X |
| 3,339,693 | 9/1967 | Mueller | 194/4 R |
| 3,473,034 | 10/1969 | Goldstern | 209/111.7 X |
| 3,543,904 | 12/1970 | Constable et al. | 194/4 C |

*Primary Examiner*—Robert B. Reeves
*Assistant Examiner*—Francis J. Bartuska
*Attorney, Agent, or Firm*—Barnes, Kisselle, Raisch & Choate

[57] ABSTRACT

For use at a non-paying exit from a vehicle parking facility, an automatic ticket chute which accepts, validates, and stores unused parking tickets of a conventional type. A ticket inserted into a ticket throat by a vehicle operator is read by an optical reader and identified as a valid parking ticket. A pinch roller drive mechanism is then energized to feed the ticket to a ticket chute whence it is shuttled to a ticket storage area.

2 Claims, 6 Drawing Figures

FIG. 1
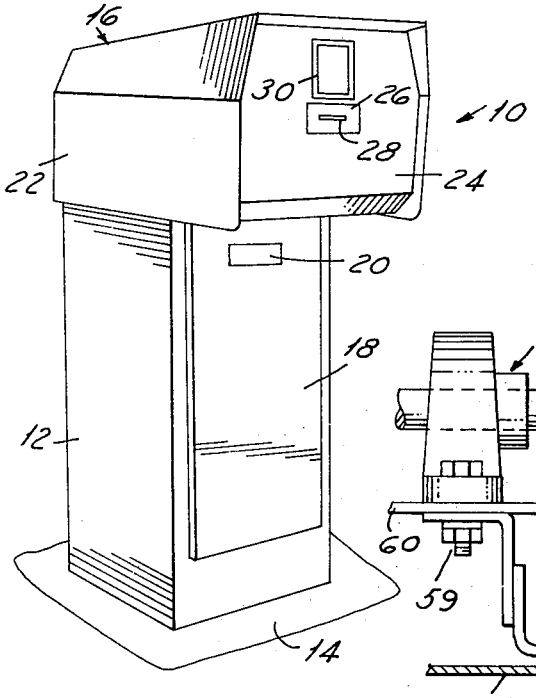
FIG. 4
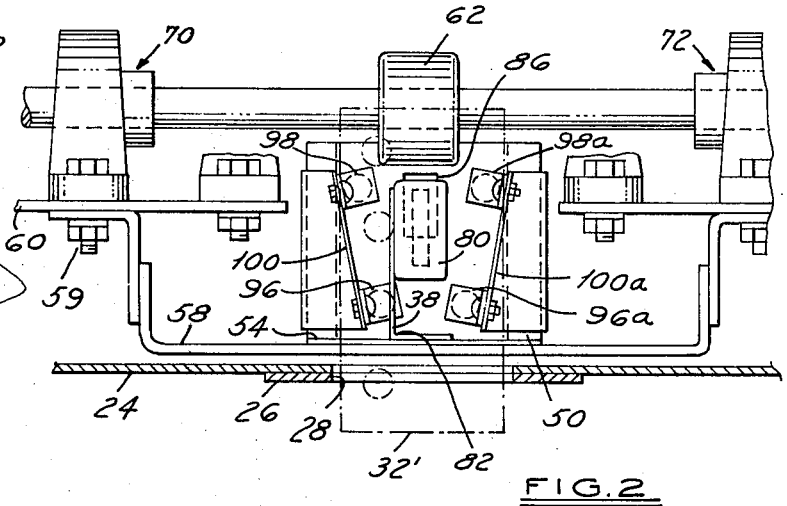
FIG. 3
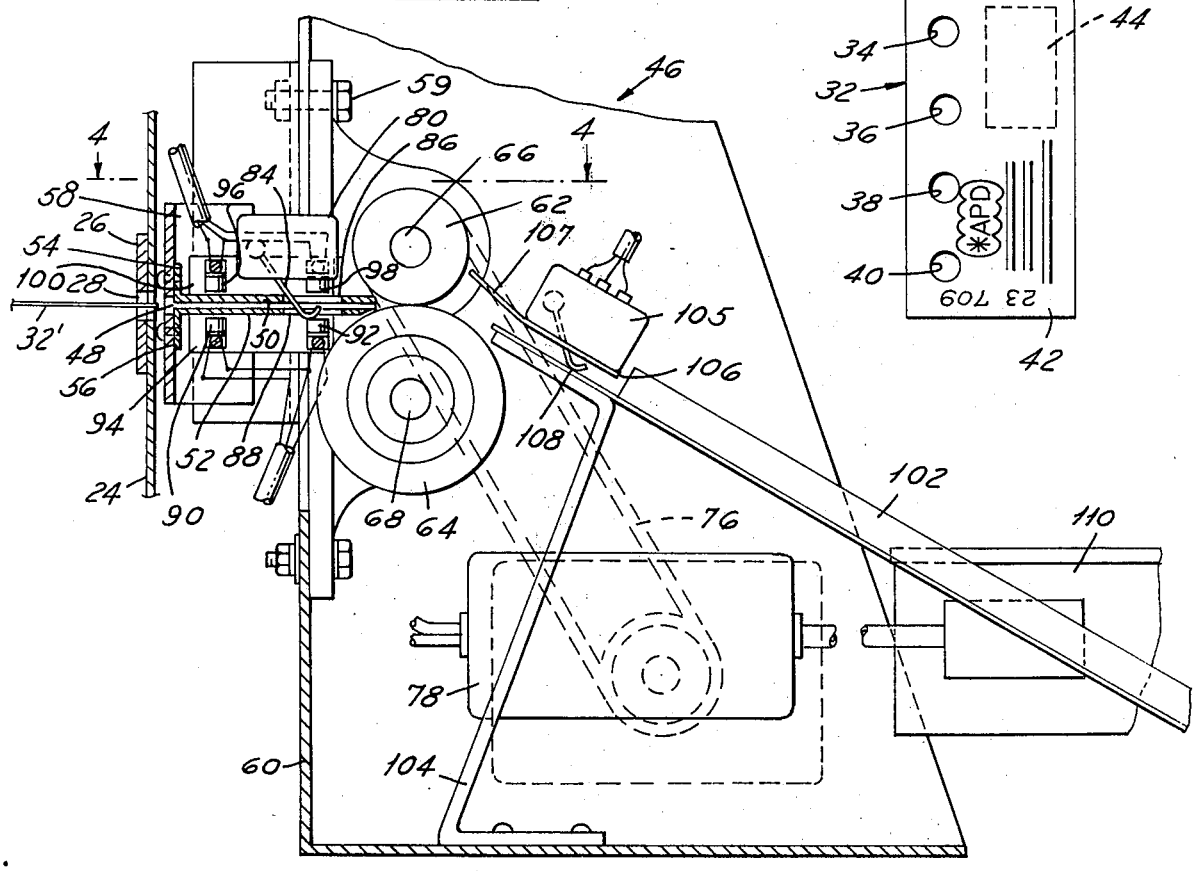
FIG. 2

AUTOMATIC TICKET CHUTE

The present invention relates to ticket vending systems and, more particularly, to an automatic ticket chute suitable for use at a non-paying exit from a vehicle parking lot.

Devices for stamping or printing time and date information upon a parking ticket and then dispensing the same to a vehicle operator are generally known in the art. Such a device, which may be located at a parking lot entrance and which will automatically dispense time-stamped parking tickets to a vehicle operator, is shown in the U.S. patent of Nutter et al. U.S. Pat. No. 2,795,875. In a ticket dispenser of this type, a roll of preprinted tickets rotatably mounted within a weatherproof housing. Upon actuation of the dispenser, as by a vehicle passing over a pressure sensitive cable or mat, a ticket is fed from the roll through a guideway or throat by a sprocketed wheel which engages prepunched holes in each ticket. Each ticket is stamped with time and date information, and is cut from the roll before dispensation. When the ticket is extracted from the dispenser throat by the vehicle operator, the dispenser signals an associated swing-arm vehicle gate to raise an associated gate arm and allow the vehicle to pass into the parking area. The swing-arm vehicle gate may be, for example, a Model G-89 gate marketed by the assignee hereof under the trade name "Auto Gate". Before egress from the parking area, the vehicle operator usually presents his parking ticket to a lot attendant who calculates a parking fee based, at least in part, upon the entrance time and date information stamped on the ticket.

However, not all exits from a vehicle parking lot are necessarily paying exits. For example, in several recently developed parking lot systems the entrance to the several rent-a-car agency lots is through a parking area rather than from a vehicle highway directly. An operator returning a rented vehicle to one of these agencies must pass through the main parking area and must, hence, receive a parking ticket at the main lot entrance; however, these operators are not expected to pay a parking fee since they are merely returning their vehicle to a rental agency. It has been found to be advantageous for the parking lot proprietor to collect these unused tickets; otherwise the rented vehicle operator could give or sell his ticket to another operator who had, by that time, accumulated a long term parking bill in the main lot. This second operator may, upon leaving the lot, use the ticket received from the rented vehicle operator and thereby deprive the parking lot proprietor of legitimate parking fees.

It is an object of the present invention to provide an automatic ticket chute suitable for use at a non-paying exit from a vehicle parking lot, which chute will accept and store unused parking tickets of the type discussed above.

It is another object of the present invention to provide an automatic ticket chute suitable for use at a non-paying exit from a vehicle parking lot which will validate objects inserted therein and which will only accept legitimate parking tickets.

In accordance with the present invention an automatic ticket chute is provided which may be located at a non-paying exit from a vehicle parking lot. The ticket chute accepts and verifies a conventional parking ticket of the type described above, and passes the ticket to a storage area. It is preferred that the automatic ticket chute provided by the invention be associated with a conventional swing-arm vehicle gate of the type described above, so that a driver presenting his ticket to the ticket chute may not leave the parking area until his ticket is validated and stored.

The novel features which are considered to be characteristic of the present invention are set forth in particular in the appended claims. The invention itself, however, together with additional objects, features and advantages thereof, will be best understood from the following description when read in conjunction with the accompanying drawings in which:

FIG. 1 is a perspective view of the automatic ticket chute provided by the present invention;

FIG. 2 is a plan view of a conventional parking ticket which will be accepted by the chute shown in FIG. 1;

FIG. 3 is a sectional view vertically bisecting the ticket validator and ticket chute mechanism provided by the present invention;

FIG. 4 is a sectional view taken along the line 4–4 of FIG. 3; and

Figure 5A:
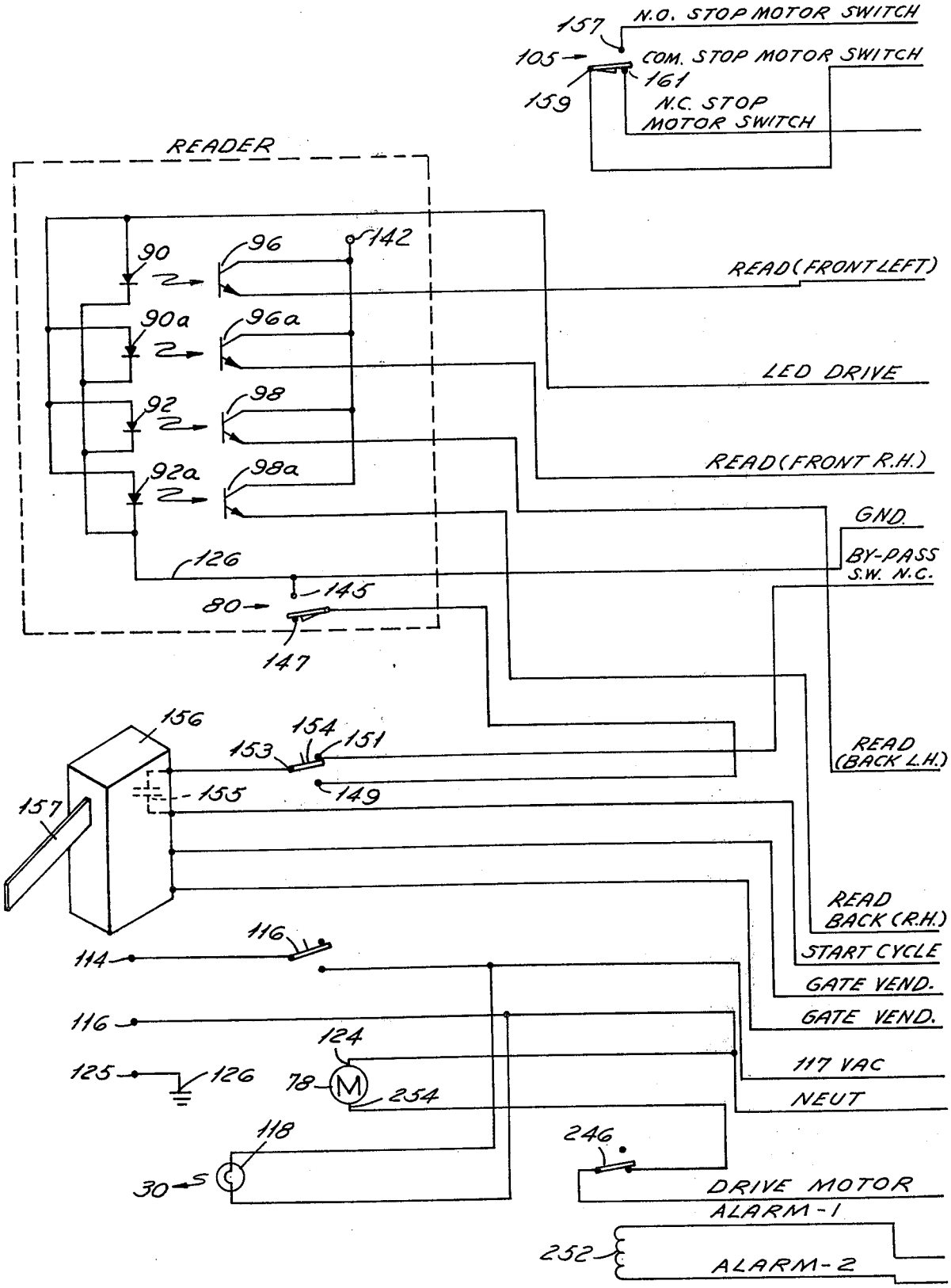
FIG. 5 (*a* and *b*) is a schematic diagram of the ticket reader and chute-command electronics provided by the present invention.

Turning first to FIG. 1 which shows a presently preferred embodiment of an assembled automatic ticket chute 10 constructed in accordance with the invention, a hollow vertical stand or base 12 extends upwardly from the ground 14 and supports a housing 16 which encloses the validator and chute mechanism, and the instrument electronics, both later to be discussed in connection with FIGS. 3–5. Base 12 has a front door 18 which is preferably locked and which may be opened by a lot attendent for connection of A/C power to chute 10 or, as will be discussed hereinafter, for disabling the ticket validator in the event of faulty operation. Door 18 bears a manufacturers nameplate 20.

Housing 16 includes a face plate 24 and a cover 22 which is preferably mounted by sliders to a housing support base (not shown) so that cover 22 may be retracted from plate 24 to expose the internal mechanism and electronics for maintenance or repair. A plastic cover 26 is carried by face plate 24 and has a horizontal slot 28 through which a parking ticket may be inserted. A plate 30 is mounted above cover 26 and bears illuminated printed indicia indicating that the ticket is to be inserted into slot 28. Preferably, base 12 and face plate 24 are designed such that a vehicle operator sitting in the driver's seat of a conventional automotive passenger vehicle may extend his arm horizontally through a side vehicle window and insert a parking ticket into slot 28.

FIG. 2 shows a conventional parking ticket 32 of the type dispensed by the apparatus disclosed in the above-referenced Nutter et al. patent. Ticket 32 includes a number of prepunched holes 34, 36, 38 and 40 by means of which the drive sprocket in the ticket dispenser engages and moves the ticket. Preprinted information indicating the name or location of the parking lot, or the name of the dispenser manufacturer, for example, is often printed on one side 42 of the ticket, while parking conditions, parking rates and liability disclaimers, etc. are printed on the reverse ticket side. Parking time and date information is stamped by the ticket dispenser in a blank area 44 on the front side 42 of the ticket.

Turning now to FIGS. 3 and 4, a presently preferred embodiment of the ticket validator and chute mechanism 46 is shown and is preferably mounted under cover 22 directly behind face plate 24 (FIG. 1). Immediately adjacent slot 28 an elongated, horizontal ticket-receiving throat 48 is defined by an upper and lower throat plate 50, 52, each of L-shaped cross section as seen in FIG. 3, and each having its foot 54, 56 fixedly attached to a throat support bracket 58. Bracket 58 is bolted as at 59 to a mechanism support chassis 60 which, in turn, is fixedly attached to the base (not shown) of housing 16 (FIG. 1). Throat 48 terminates remotely of face plate 24 of a pair of pinch rollers 62, 64 respectively mounted to horizontal parallel shafts 66, 68. Shaft 66 is journalled to chassis 60 as indicated at 70, 72 of FIG. 4. Shaft 68 is similarly journalled to the chassis. A drive pulley (not shown) is affixed to shaft 66 and is connected by a belt 76 to a drive motor 78. Roller 62 thus comprises the ticket drive roller, while roller 64 comprises a follower or free turning roller. It will be noted with respect to FIG. 3 that rollers 62, 64 are in continuous contact, preferably with the contact force therebetween being sufficient to slightly compress the respective roller peripheries. The line of contact between rollers 62, 64 is horizontally aligned with throat 48 and is spaced from slot 28 by a distance somewhat less than the length of one ticket so that rollers 62, 64 provide a stop for a ticket inserted into the throat. This is figuratively shown in FIG. 4 wherein a ticket 32′ is depicted in phantom inserted into throat 48.

A switch 80 is fixedly mounted to chassis 58 above throat 48 by means of a bracket 82, and has an actuator arm 84 which normally depends into the throat through the aligned openings 86, 88 in plates 50, 52 respectively. When ticket 32′ is inserted into throat 48 and moved toward contact with rollers 62, 64, the front or entering edge of the ticket engages actuator arm 84 and lifts the same upwardly so that switch 80 is activated. To insure that an object inserted into throat 48 is a valid parking ticket, an optical reader is mounted to chassis 60 to read a ticket held in place within the throat by rollers 62, 64. A pair of light emitting circuit elements 90, 92 such as LED's (light emitting diodes) are mounted by means of a bracket 94 to lower throat plate 52. A pair of photosensitive circuit elements 96, 98 such as phototransistors are mounted by means of a bracket 100 to upper throat plate 50 in vertical alignment with LED's 90, 92 respectively. Respective holes (not shown) in plates 50, 52 allow optical communication between LED's 90, 92 and phototransistors 96, 98. As best seen in FIG. 4, phototransistors 96, 98 (and LED's 90, 92) are mounted on a horizontal line which is angulated slightly with respect to the major horizontal axis of throat 48. Furthermore, phototransistor 96 and LED 90 are located a preselected distance from rollers 62, 64 such that, when a ticket is fully inserted into throat 48 as shown at 32′ of FIG. 4, LED 90 and phototransistor 96 are optically coupled through a sprocket hole 38′ of the ticket. On the other hand, optical coupling between LED 92 and phototransistor 98 is blocked by the margin of ticket 32′ as indicated in FIG. 4.

Since no information is to be imprinted upon the parking ticket and only the presence or absence of a valid ticket is to be sensed, orientation of the ticket, i.e., right-side up, up-side down, backward or forward, should be of no consequence to automatic ticket chute 10 (FIG. 1). As shown in FIG. 2 sprocket holes 34, 36, 38 and 40 are uniformly spaced lengthwise of ticket 32 so that LED's 90, 92 and phototransistors 96, 98 will validate any ticket inserted into throat 48 with the sprocket holes aligned along the left side of the ticket as shown in FIG. 4. To validate a ticket inserted into the throat with the sprocket holes along the right hand side thereof, the LED's 90*a*, 92*a* (not shown) and the phototransistors 96*a*, 98*a* are respectively mounted to brackets 94*a* (not shown) and 100*a* in complementary or mirror-image relationship with LED's 90, 92 and phototransistors 96, 98. Thus, an object inserted into ticket throat 48 is confirmed as a valid parking ticket by optical coupling between element pairs 90, 96 or 90*a*, 96*a*, but not both, and by the absence of optical coupling between both of the element pairs 92, 98 and 92*a*, 98*a*. This ticket-validator logic makes is relatively difficult to "fool" ticket chute 10 provided by the present invention, as by insertion of a scrap of paper or a knife blade for example.

An elongated chute 102 which is U-shaped in axial cross section is mounted rearwardly of rollers 62, 64, i.e., remotely of throat 48, and is affixed to chassis 60 by a bracket 104. A switch 105 is mounted upon a bracket 106 above the base of chute 102 at the chute entrance, bracket 106 having a flared edge 107 adjacent rollers 62, 64 to better guide tickets passed through the rollers into chute 102. Switch 105 has an actuator arm 108 which passes through a hole (not shown) punched into bracket 106 and depends into the entrance of chute 102 to sense passage of a ticket into the chute, the leading edge of a passing ticket pushing arm 108 upwardly and thus actuating switch 105. A ticket fed into chute 102 is passed into a storage area which may comprise a box or bin (not shown) located in base 12 (FIG. 1). LED's 90, 92, 90*a*, 92*a*, phototransistors 96, 98, 96*a*, 98*a*, switches 80, 105 and drive motor 78 are connected via associated cables to an electronic chassis 110, the contacts of which are next to be described in connection with FIGS. 5*a* and 5*b*.

Figure 5B:
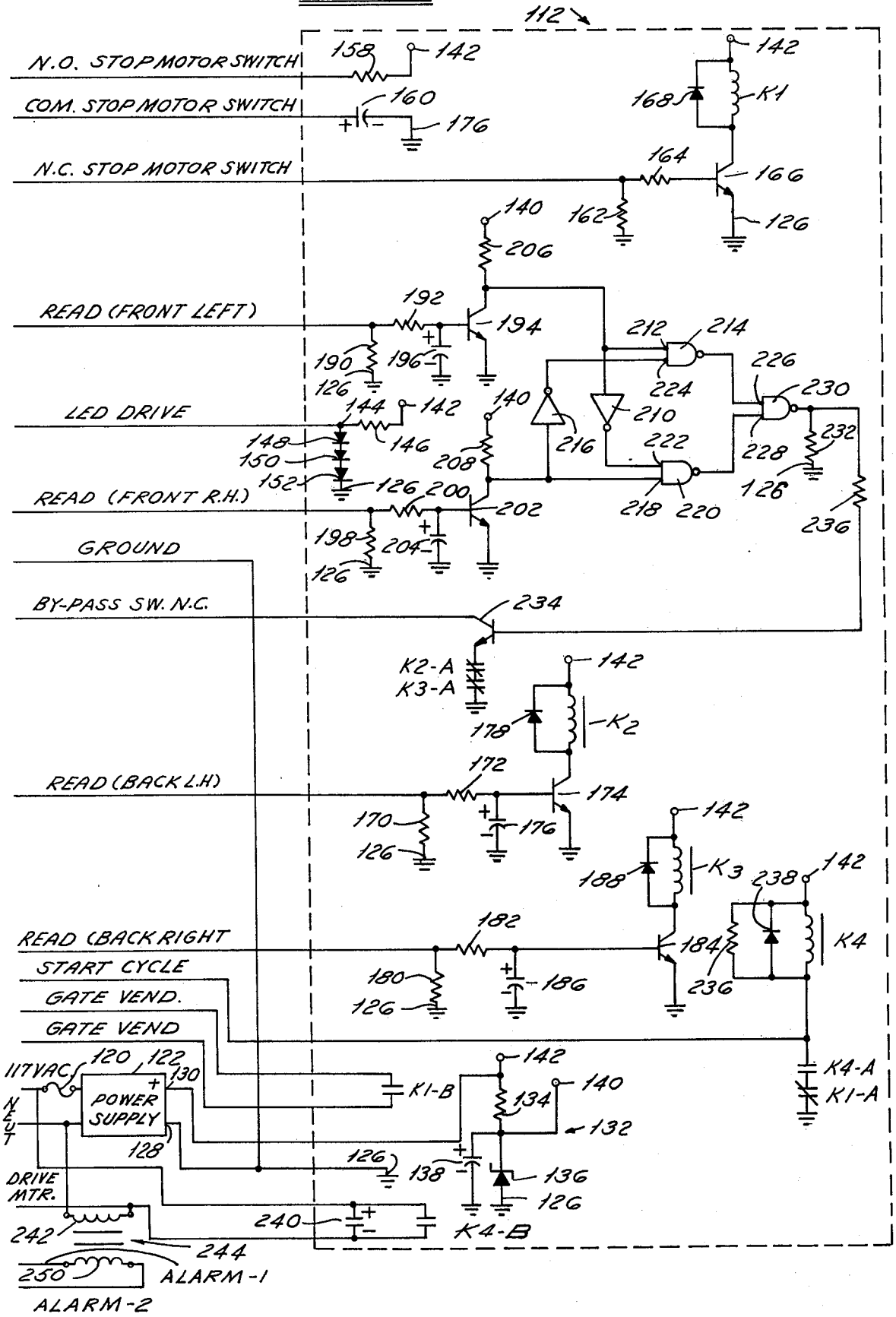

With correspondingly labeled conductors in the respective figures connected, FIGS. 5*a* and 5*b* together depict a presently preferred embodiment of the control electronics 112 housed within electronics chassis 110 (FIG. 3). Referring to FIGS. 5*a* and 5*b*, 117VAC is fed from a terminal 114 through a normally open power switch 116 which is physically located within base 12 (FIG. 1) and which is closed by a lot attendant to apply power to the chute electronics. From switch 116, 117VAC is fed to one side of a lamp 118 which illuminates plate 30 (FIG. 1), and through a fuse 120 to a power supply 122. The neutral side of 117VAC is fed from a terminal 116 to lamp 118, power supply 122 and to one terminal 124 of drive motor 78 (FIG. 3). A/C ground is connected from a terminal 125 to signal and chassis ground 126. To operate the automatic ticket chute, terminals 114, 116 and 125 must, of course, be connected in the usual manner to a suitable source of electric power (not shown).

Power supply 122 has its negative output 128 connected to ground 126, and its positive output 130 connected to a voltage regulator 132. Regulator 132 comprises a resistor 134 having one lead connected to power supply terminal 130, and a second lead connected to ground 126 through the parallel combination of the cathode-anode junction of a zener diode 136 and a capacitor 138. The voltage across Zener diode 136 is held at the reverse breakdown voltage thereof and is available for use in control circuit 112 at a power bus 140. The raw output of power supply 122 at terminal 130 is available to the remainder of the control circuitry at a second power bus 142.

The optical reader or validator provided by the present invention has already been discussed in connection with FIGS. 3 and 4, and is depicted schematically in FIG. 5*a*. Front, left and right LED's (as viewed in FIG. 4) 90, 90*a*, and back left and right LED's 92, 92*a* are all connected in parallel with the cathodes thereof connected to ground 126 and the anodes thereof connected to an LED drive voltage terminal 144 within control circuit 112 (FIG. 5*b*). Terminal 144 is connected to bus 142 through a resistor 146, and to ground 126 through the anode-cathode junctions of three series-connected silicon diodes 148, 150 and 152. Thus, the voltage across LED's 90, 90*a*, 92 and 92*a* is equal to three diode voltage drops, or approximately 2.1 volts. Front left and right phototransistors 96, 96*a*, and rear left and right phototransistors 98, 98*a* have their collectors connected together to bus 142 and their emitters connected through separate sensing circuits to validation logic in control circuit 112. As shown schematically in FIGS. 5*a* and 5*b*, switch 80 (FIGS. 3 and 4) has its normally open contact 145 connected to ground 126 and its common contact 147 connected to the normally open terminal 149 of a normal/bypass switch 154. Switch 154 has its normally closed terminal 151 connected directly to control circuit 112, and its common terminal 153 connected to control circuit 112 through a normally closed interlock switch 155. Interlock switch 155 is conventionally located in a swing-arm vehicle gate 156, which may be of the type described above, and is closed when gate arm 157 is in the lowered position.

As shown schematically in FIGS. 5*a* and 5*b*, switch 105 (FIG. 3) is of the single pole, double throw type and has a normally open contact connected in control circuit 112 through a resistor 158 to voltage bus 142, a common contact 159 connected in control circuit 112 through a capacitor 160 to ground 126, and a normally closed contact 161 connected in the control circuit through a resistor 162 to ground and also through a resistor 164 to the base of an NPN transistor 166. Transistor 166 has its emitter connected to ground 126 and its collector connected through a relay coil K1 to voltage bus 142. An arc suppression diode 168 is connected across relay coil K1 in the reverse voltage direction to suppress inductive ringing in the coil when transistor 166 turns off. When switch 105 is activated, as by passage of a ticket between rollers 62, 64 into chute 102 (FIG. 3), common contact 159 is connected through normally opened contact 157 to bus 142 such that a voltage is developed across capacitor 160 which is approximately equal to that on bus 142. When switch 105 is thereafter deactivated, as by passage of a ticket past actuator arm 108 (FIG. 3) and into the proper chute, capacitor 160 is connected through resistor 164 to the base of transistor 166, thus turning on transistor 166 and energizing relay coil K1. Coil K1 remains energized until the voltage on capacitor 160 has discharged, at which time transistor 166 turns off, relay coil K1 is de-energized and the circuit assumes its quiescent state.

The emitter of left rear phototransistor 98 is connected in control circuit 112 through a resistor 170 to ground 126, and through a resistor 172 to the base of an NPN transistor 174 which has its emitter connected to ground. The base of transistor 174 is also connected to ground through a noise suppression capacitor 176 while the collector thereof is connected through a relay coil K2 to voltage bus 142. An arc suppression diode 178 is connected in the reverse voltage direction across relay coil K2. Thus, when left rear phototransistor 98 is turned on as by optical coupling between the base thereof and LED 92, transistor 174 is turned on and relay coil K2 is energized. The emitter of right rear phototransistor 98*a* is connected through a resistor 180 to ground 126, and through a resistor 182 to the base of an NPN transistor 184. The base of transistor 184 is also connected to ground through a noise suppression capacitor 186, while the emitter thereof is connected directly to ground and the collector thereof is connected to voltage bus 142 through a relay coil K3. The usual arc suppression diode 188 is connected across relay coil K3. Turn-on of phototransistor 98*a*, as by optical coupling with LED 92*a*, thus turns on transistor 184 and energizes relay coil K3.

The emitter of right front phototransistor 96 is connected in control circuit 112 through a resistor 190 to ground 126, and through a resistor 192 first to the base of an NPN transistor 194 and thence to ground 126 through a noise suppression capacitor 196. Similarly, the emitter of right front phototransistor 96*a* is connected through a resistor 198 to ground 126, and through a resistor 200 first to the base of an NPN transistor 202 and thence to ground through a noise suppression capacitor 204. The emitters of transistors 194, 202 are connected directly to ground while the collectors thereof are connected to voltage bus 140 through the respective resistors 206 and 208. The collector of transistor 194 is also connected to the input of an inverter 210 and to one input 212 of a conventional NAND (Not-AND) gate 214. Similarly, the collector of transistor 202 is connected to the input of an inverter 216 and to one input 218 of a NAND gate 220. The output of inverter 210 is connected to a second input 222 of NAND gate 220 while the output of inverter 216 is connected to a second input 224 of NAND gate 214. The outputs of gates 214, 220 are connected to the respective inputs 226, 228 of a NAND gate 230 which has its output connected to ground 126 through a resistor 232 and to the base of an NPN transistor 234 through a resistor 236. The collector of transitor 234 is connected to normally closed contact 151 of normal/-bypass switch 154, while the emitter thereof is connected to ground through a pair of normally closed contacts K2-A associated with relay coil K2, and then through a pair of normally closed contacts K3-A associated with relay coil K3.

The common contact of switch 154 is connected through auto-gate interlock switch 155 back into control circuit 112 to voltage bus 142 through a relay coil K4. A resistor 236 and an arc suppression capacitor 238 are parallel-connected across relay coil K4. Relay coil K4 is also connected to ground through a pair of normally open contacts K4-A associated with relay coil K4, and thence through a pair of normally closed contacts K1-a associated with relay coil K1. A pair of normally open relay contacts K1-B associated with relay coil K1 provides a gate vend signal and is connected to conventional gate drive circuitry in swing-arm vehicle gate 156. A pair of normally open relay contacts K4-B, also associated with relay coil K4, has an arc suppression capacitor 240 connected thereacross and, when closed through activation of coil K4, connects 117VAC to neutral through the primary winding 242 of a step-down transformer 244. When thus closed, contact set K4-B also connects 117VAC (via terminal 114 and switch 116) through a normally closed switch 246 to a second terminal 254 of drive motor 78. The secondary winding 250 of transformer 244 is connected to an alarm or buzzer coil 252. Thus, closure of contact set K4-B causes excitation of buzzer 252 and energization of drive motor 78. Switch 246 is preferably located in base 12 (FIG. 1) and may be placed in the open condition by a lot attendant should circuit 112 malfunction.

Operation of automatic ticket chute 10 provided by the present invention, and particularly of control circuit 112, is as follows: Ticket chute 10 (FIG. 1) is first approached by an operator in his vehicle and a ticket of the type shown in FIG. 2 is inserted through slot 28 into ticket throat 48 (FIG. 3) until the ticket hits pinch rollers 62, 64. Optical coupling between rear phototransistors 98, 98*a* and their associated LED's should be blocked by the margin of the ticket as discussed above in connection with FIG. 4 so that transistors 174 and 184 of FIG. 5*b* are nonconductive, and relay coils K2 and K3 are de-energized. Transistors 194, 202, inverters 210, 216, and NAND gates 214, 220 and 230 comprise an exclusive-or circuit which detects optical coupling between either one of the front LED/phototransistor element paris, but not both. Stated differently, when a valid parking ticket having the appropriate holes punched along one side thereof is inserted into the ticket throat as shown in FIG. 4, optical coupling should exist between one front phototransistor and its associated LED, but not between both phototransistors and their associated LED's.

Thus, where the ticket is inserted as shown in FIG. 4, the base of phototransistor 96 is exposed to light emitted from LED 90 while the base of phototransistor 96*a* is blocked with respect to LED 90*a*. In this situation transistor 194 (FIG. 5*b*) conducts while transistor 202 remains nonconductive, placing a logical one at the input of inverter 216 and at input 218 of NAND gate 220, and placing a logical zero at the input of inverter 210 and at input 212 of NAND gate 214. The zero at the input of inverter 210 is logically inverted therein so that a logical one is placed at input 222 of NAND gate 220 causing a zero at the output thereof and at input 228 of gate 230. Similarly, the logical one input to inverter 216 is inverted therein such that logical zeros appear at both inputs of gate 214. Input 226 of gate 230 is thus at a logical one. A logical one at input 226 and a logical zero at input 228 results in a logical one output from gate 230 tending to forward bias the base-emitter junction of transistor 234. Since both rear optical couplers are blocked as indicated above, relay coils K3 and K4 are de-energized and contact sets K2-A and K3-A at the emitter of transistor 234 are both closed. Transistor 234 thus turns on.

Assuming for the moment that switch 154 is in the normal position indicated in FIG. 5*a*, and assuming that interlock switch 155 is closed indicating that gate arm 157 is in the fully lowered position, turn-on of transistor 234 energizes relay coil K4 thereby closing contact sets K4-A and K4-B. Contact set K4-A, when closed, provides an excitation current path for coil K4 through contact set K1-A to ground, thus latching coil K4 on independently of transistor 234. Contact set K4-B energizes buzzer coil 252 providing an indication to a remote parking lot attendant that the auto ticket chute is in operation, and also applies 117VAC across drive motor 78 through normally closed switch 246. Rollers 62, 64 of FIG. 3 are now driven by motor 78 such that the ticket pinched therebetween is fed to the entrance of chute 102.

Upon entrance of the ticket into chute 102, switch 105 is activated such that capacitor 160 is charged through resistor 158. The drive motor continues to run under control of relay contact at K4-B as the ticket passes underneath switch 105. When the ticket has passed switch 105 such that the actuator arm thereof assumes its normal position, capacitor 160 discharges through resistor 162 and transistor 166, thus turning on the transistor and energizing relay coil K1. With coil K1 thus activated, normally closed contact set K1-A is open de-energizing relay coil K4 and turning off the ticket drive motor. Normally open contact set K1-B is closed applying a gate vend signal to gate 156 so that arm 157 beings its upward excursion. When capacitor 160 has discharged, coil K1 is de-energized and contact sets K1-A and K1-B assume their normal conditions.

It will be evident from the foregoing discussion that, should ticket 32′ of FIG. 4 be inverted or rotated 180° about its longitudinal axis before insertion thereof into throat 48, right front phototransistor 96*a* will be optically coupled to its associated LED while optical coupling between phototransistor 96 and LED 90 will be blocked. In this situation, transistor 202 will be turned on while transistor 194 will remain off, gate 214 will have two logical one inputs while gate 220 has two logical zero inputs, and the outputs of gate 230 will again be a logical one. The operation sequence will thus proceed as described above.

Where neither front phototransistor is coupled to its associated LED, transistor 194 and 202 will both be turned off such that logical ones appear at gate inputs 212, 218 while logical zeros appear at gate inputs 224, 222. Inputs 226 and 228 of gate 230 are then both at a logical one such that the output thereof is low and the base-emitter junction of transistor 234 is reverse biased. Similarly, where phototransistors 96 and 96*a* are both exposed, transistors 194 and 202 both conduct placing logical zeros at gate inputs 212, 218 and logical ones at gate inputs 222, 224. Again the output of gate 230 will be a logical zero so that transistor 234 is nonconductive. Thus, it will be seen that the ticket verification circuit comprising transistors 194, 202, inverters 210, 216, and NAND gates 214, 220 and 230 has a function which is described by the following exclusive-or logic equation:

$$(\overline{96} \cdot 96a) + (96 \cdot \overline{96a})$$

wherein 96 and 96*a* respectively indicates conduction of phototransistors 96 and 96*a*, and $\overline{96}$ and $\overline{96a}$ respectively indicate nonconduction of the associated phototransistors. Of course, should either of the rear phototransistors 98, 98*a* be exposed, the associated relay K2 or K3 will be energized, contact set K2-A or K3-A will be opened and conduction of transistor 234 will be inhibited.

In the remote chance that either the optical reader of the control circuit should fail, a parking lot attendant may merely activate normal/bypass switch 154 connecting common contact 153 thereof to normally open contact 149, and thereby allowing continued operation of automatic ticket chute 10 provided by the present invention. In this mode of operation, a ticket inserted into throat 48 activates switch 80 as described above in connection with FIG. 3, at which time relay coil K4 will be energized through interlock switch 155, bypass switch 154 and switch 80. Drive motor 78 is then energized via contact set K4-B, and relay coil K4 is latched in the energized condition by contact set K4-A as described above. The charging and discharging of capacitor 160, and the cycling of relay coil K1 takes place in the above-described fashion, sending the gate vend signal to gate 156. When the ticket passes into the ticket chute, switch 80 is deactivated.

From the foregoing description it will now be apparent that there has been provided in accordance with the present invention an automatic ticket chute which fully satisfies all of the objects, features and advantages set forth above. While the invention has been described in conjunction with a specific, presently preferred embodiment thereof, numerous alternatives, modifications and variations will suggest themselves to persons skilled in the art in view of the foregoing description. Accordingly, the present invention is intended to embrace all such alternatives, modifications and variations as fall within the spirit and broad scope of the appended claims.

The invention claimed is:

1. An automatic ticket chute comprising a ticket throat having an entrance to receive a ticket, means responsive to insertion of a ticket into said throat to develop a drive signal, drive means disposed adjacent said throat remotely of said throat entrance and responsive to said drive signal to pull the ticket through said throat, chute means having an entrance disposed adjacent said drive means remotely of said throat entrance to receive a ticket upon activation of said drive means, means disposed at said chute entrance activated by a ticket passing into said chute, and means responsive to said ticket-activated means to terminate said drive signal; said insertion responsive means comprising first switch means having a normally open circuit condition and being activated to a closed circuit condition upon insertion of said ticket into said throat, first relay coil means connected in series with said first switch means across a source of electrical power and first contact means operatively associated with said first relay coil means to develop said drive signal when said first relay coil is energized; said drive signal terminating means comprising charge storage means storing a preselected charge upon activation of said second switch means, second relay coil means energized upon deactivation of said switch means for a preselected time proportional to said preselected charge, and second contact means connected in series with said first relay coil means and operatively associated with said second relay coil means to de-energize said first relay coil means when said second relay coil is energized.

2. The automatic ticket chute set forth in claim 1 for use with a swing-arm vehicle gate of the type in which a vehicle gate arm is raised in response to a gate vend signal, said automatic ticket chute further comprising third contact means operatively associated with said second relay coil means to provide said gate vend signal.

* * * * *